US008769730B2

(12) United States Patent
Pohler et al.

(10) Patent No.: US 8,769,730 B2
(45) Date of Patent: Jul. 8, 2014

(54) MACERATING APPARATUS AND METHOD

(75) Inventors: Donald M. Pohler, North Chili, NY (US); Matthew S. Heinsler, Lyndonville, NY (US)

(73) Assignee: Liberty Pumps, Inc., Bergen, NY (US)

( * ) Notice: Subject to any disclaimer, the term of this patent is extended or adjusted under 35 U.S.C. 154(b) by 415 days.

(21) Appl. No.: 13/027,878

(22) Filed: Feb. 15, 2011

(65) Prior Publication Data

US 2012/0204337 A1 Aug. 16, 2012

(51) Int. Cl.
*E03D 9/10* (2006.01)
*B02C 18/00* (2006.01)
*E03D 11/11* (2006.01)

(52) U.S. Cl.
CPC . *E03D 9/10* (2013.01); *E03D 11/11* (2013.01); *B02C 18/0092* (2013.01)
USPC ..... 4/319

(58) Field of Classification Search
USPC ..... 4/319–320; 241/46.017; 210/173
See application file for complete search history.

(56) References Cited

U.S. PATENT DOCUMENTS

| | | | | |
|---|---|---|---|---|
| 3,094,707 | A * | 6/1963 | Fleming | 4/319 |
| 3,755,827 | A * | 9/1973 | Riedel et al. | 4/317 |
| 4,159,550 | A | 7/1979 | Tobin, Jr. | |
| 4,791,688 | A | 12/1988 | Krishnakumar et al. | |
| 6,000,067 | A * | 12/1999 | Cascia | 4/223 |
| 6,305,410 | B1 | 10/2001 | Cook et al. | |
| 6,430,757 | B1 | 8/2002 | Pohler | |
| 6,662,382 | B2 * | 12/2003 | Rump et al. | 4/304 |
| 7,203,976 | B1 | 4/2007 | Weller et al. | |
| 7,563,082 | B2 | 7/2009 | Pohler | |
| 2006/0096017 | A1 * | 5/2006 | Yamasaki et al. | 4/420 |

FOREIGN PATENT DOCUMENTS

DE 2309400 B1 9/1974

OTHER PUBLICATIONS

Liberty Pumps Installation Manual for Ascent TM Toilet Pumping System, published 2008, electronically filed pdf file 20110922_13-027878_IDS_NPL_Cite1.

Liberty Pumps sales pamphlet for Ascent TM MaceratingToilet System, published 2009, electronically filed pdf file 20110922_13-027878_IDS_NPL_Cite2.

Saniflo Saniplus(R) Internet web pages of product information (pp. 1-5) Installation and Maintenance Instructions (pp. 9-16) and Internet press release announcing product offering Mar. 1, 2010; electronically filed pdf file 20110922_13-027878_IDS_NPL_Cite3.

International Search Report of Jul. 11, 2012 in copending application PCT/US2012/024595, EFS file name 20130204_13-027878_IDS_NPL_Cite1.

* cited by examiner

*Primary Examiner* — Huyen Le
*Assistant Examiner* — Janie Christiansen
(74) *Attorney, Agent, or Firm* — Patent Innovations LLC; John M. Hammond

(57) ABSTRACT

A macerating apparatus for a toilet in which the problem of jamming the macerator at startup is solved by rapidly detecting the flushing of the toilet and accelerating the macerator before motion-jamming solid objects in the effluent from the toilet can reach the macerator. The macerating apparatus may be comprised of a macerating cutter operatively connected to a motor, and a sensor in communication with the motor. The sensor may detect the flow of effluent from the toilet toward the macerator, the flow of makeup water from the supply tank into the toilet, or the mechanical action of the mechanism used to flush the toilet. The apparatus may include an intake basket having an asymmetric inlet tube and containing the macerating cutter, wherein the asymmetry of the inlet tube provides additional operating clearance between a cutting blade of the macerating cutter and the intake basket.

20 Claims, 16 Drawing Sheets

MACERATING APPARATUS AND METHOD

BACKGROUND

1. Field of the Invention

Macerating toilet systems, which may be operated at a location below gravity drain piping, and which may also be installed without requiring connection to a drain pipe that is located below the surface upon which such a system is disposed.

2. Description of Related Art

Maceration, in sewage treatment, is the use of a machine that reduces solids to small pieces in order to deal with tissue paper, excrement, rags and other solid waste. Macerating toilets use a grinding or blending mechanism to reduce human waste to a slurry, which can then be moved by pumping. Such a toilet is useful in situations where the desired location of the toilet is below the location of gravity drain piping in a building, thus requiring the effluent from the toilet to be pumped upwardly to reach the discharge location of sewage piping from the building. Such a toilet is also useful because it may be configured so as to discharge laterally from its base, rather than from a discharge opening on the bottom of a base. This enables the toilet to be simply bolted in place to a supporting surface, and the water supply and effluent connections to be made to it, rather than breaking into the structure beneath the supporting surface to enable discharge from the toilet out its bottom. In circumstances where the installation of the toilet is "after the fact," and installation is desired that was otherwise unplanned, such as on a concrete basement floor (which may be reinforced with rebar), a toilet with a lateral discharge that can be connected directly to discharge piping is especially advantageous. It obviates the need to disrupt the floor or place the toilet upon a raised pedestal, which would otherwise be needed for a bottom discharge toilet. Breaking into a concrete floor is obviously difficult, and placing a toilet on a pedestal may be undesirable, such as if there is limited overhead clearance.

In circumstances requiring a horizontal or upward effluent discharge, a macerating toilet is required. This is because in both cases (or the combination of them), the effluent from the toilet must be pumped at least horizontally, and also possibly upwardly. However, such effluent contains tissue paper and excrement, and may also contain other solid waste such as rags, cigarette butts, sanitary napkins, and even unintended articles such as socks or other objects flushed down by inquisitive children.

In order for the effluent from the toilet to be pumped horizontally and/or upwardly, these articles must be ground completely into a liquid slurry that a pump can handle without jamming, breaking, or clogging. Thus a macerating apparatus is needed, either as a separate device upstream from the pump, or integrally provided as a part of the pump at the inlet thereof.

Toilets with a lateral discharge into a nearby enclosure are known. U.S. Pat. No. 7,203,976 to Weller, the disclosure of which is incorporated herein by reference, discloses a floor level pumping system that is non-disruptive to the existing flooring and including a conventional rear outlet toilet. The system comprises a floor level tank for receiving waste and fluid from the outlet of the toilet including a tank chamber containing a designated area with a sensing system which activates a discharge pump when the level or quantity of the waste and fluid within the tank chamber reaches a predetermined level. The chamber further includes one or more baffles extending upwardly from a floor of the tank chamber, at least partially segregating the designated area from the remaining area of the tank chamber, and a discharge pump for pumping waste from the floor level tank out through a discharge pipe.

The placement of an enclosure with a macerator and a pump at the discharge of a toilet results in certain problems that are not otherwise present with a typical conventional bottom-discharge toilet. Some of these problems have not been solved by existing macerating toilet systems.

One problem is that because a macerating toilet with a pump and macerator device is more complex than a conventional bottom-discharge toilet, it requires more maintenance. Cutters on the macerator become worn and dull, and must be periodically replaced. The macerator system may have level and/or flow sensors which may become fouled and require cleaning or replacement. In a circumstance where a non-grindable solid object is flushed into the macerator, such as a small toy, it will jam the macerator. There is no alternative other than to access the macerator and remove the object. In all cases, because of the sewage present, accessing such components is an unsanitary and unpleasant task. In a typical prior art macerating apparatus, an entire top cover must be removed from the macerator tank to access the internal components. Piping connections must be dismantled from the pump contained in the tank, and level switches and/or other electrical sensing and control equipment must be disconnected and/or removed. All of this must be done in the presence of unsavory contents within the tank.

A second problem is that when certain level and/or flow sensors become fouled, they may provide a false signal such as a high level alarm. Even though the macerating unit and pump are in working order, the false alarm causes the entire toilet system to become inoperable such that it cannot be used. There are no provisions to communicate sensor condition to a user, while temporarily overriding the sensor output and maintaining operability of the toilet.

There is therefore a need for a macerating toilet that operates in a manner that avoids the need for maintenance to the greatest extent possible; but when maintenance is needed, which also enables such maintenance in as simple and sanitary a manner as possible.

SUMMARY

In accordance with the invention, a macerating apparatus for a toilet is provided in which the problem of unsanitary and/or difficult maintenance of the macerator on a macerating toilet is solved by providing a modular macerating unit that is easily moved to a convenient maintenance position, and if necessary, easily removed from the tank. In certain embodiments, the macerating apparatus may be comprised of a tank having an open top, a macerating unit disposed in the tank, and a main cover joined to the open top of the tank and comprising an opening. The macerating unit is movable from an operating position to a maintenance position beneath the opening. From the maintenance position, the macerating unit may be removed from the tank through the opening in the main cover. The apparatus may be further comprised of an access cover fittable to the opening in the main cover and extending within the tank so as to hold the macerating unit in the operating position when the access cover is fitted to the main cover. The macerating unit may be laterally displaced from the operating position to the maintenance position when the access cover is removed from the main cover. The macerating unit may be disposed in a track on a bottom surface of the tank such that the track guides the motion of the macerating unit between the operating position and the maintenance position.

In further accordance with the invention, a macerating apparatus for a toilet is provided in which the problem of fouled sensors disrupting the operation of the macerating apparatus and the toilet is solved by providing an adaptive control system for operation of the apparatus. In certain embodiments, the macerating apparatus may be comprised of a macerating cutter disposed in a tank, and the adaptive control system in communication with the cutter. The system may comprise first and second sensors in communication with the controller, wherein when the first sensor detects a flushing of the toilet, the controller causes the cutter to operate for a first run time; and when the second sensor detects a level of liquid in the tank, the controller causes the cutter to operate for a second run time; and when the controller detects that the first sensor is inoperable and the second sensor detects the level of liquid in the tank, the controller causes the cutter to operate for the first run time. Because the flushing of a toilet detected by the first sensor typically contains solids which must be macerated, the first run time is preferably greater than the second run time, which typically only requires the pumping of gray water. In one embodiment of the apparatus, the cutter may be operatively connected to a motor, wherein the controller monitors the load of the cutter on the motor and varies the first run time depending upon the load on the cutter. The run time is increased for as long as necessary to fully macerate the solids, at which time the load on the motor decreases.

Another aspect of the Applicants' macerating apparatus is based on the observation of another problem with conventional macerating apparatus. The Applicants have observed that when certain solid objects, such as the aforementioned tissue paper, rags, cigarette butts, sanitary napkins, socks, etc., are present within the toilet or within the macerating tank upstream from the macerator and in an unmacerated state, when a flush is initiated, such objects are often drawn into the macerator before it can accelerate to operating speed, and cause the macerator to jam. In some instances, the cutters of the macerator do not even make a single rotation before jamming occurs against a solid object. Such jamming renders the macerator inoperable. The Applicants have observed that in a conventional macerator apparatus, the operating sensors are located in the macerating tank and programmed such that they do not trigger the macerating unit to start up until it is too late—until solid objects are at or near the macerating cutter.

The Applicants have hypothesized that if a macerator were allowed to reach operating speed before a solid object contacts it, the object would be macerated, taken in by the pump, and discharged in the desired routine manner. Subsequent experimental testing confirmed this hypothesis. In accordance with the invention, therefore, a macerating apparatus for a toilet is provided in which the problem of jamming the macerator at startup is solved by rapidly detecting the flushing of the toilet and accelerating the macerator before potentially motion jamming solid objects in the effluent from the toilet can reach it. The macerating apparatus may be comprised of a macerating cutter operatively connected to a motor, and a sensor in communication with the motor. The sensor may detect the flow of effluent from the toilet toward the macerator, the flow of makeup water from the supply tank into the toilet, or the mechanical action of the actuator to flush the toilet. The sensor detects the toilet flushing at the beginning or early in the toilet flushing cycle, and causes the motor to start and operate the macerating cutter before the effluent containing solid objects contacts the macerating cutter. In certain embodiments, when effluent is discharged from the toilet toward the macerating unit, the sensor detects the discharge and causes the motor to start and operate the macerating cutter before the effluent contacts the macerating cutter. There is thus also provided a method of macerating an effluent stream from a toilet. The method comprises detecting flushing of the toilet that causes the effluent stream, and starting a macerating unit comprising a macerating cutter operatively connected to a motor and accelerating the macerating cutter to an operating speed prior to the effluent stream reaching the macerating cutter.

Another aspect of the Applicants' macerating apparatus is based on the observation of yet another problem with conventional macerating apparatus. The Applicants have observed that at the junction between an inlet tube and a macerating basket of a macerator, if a tight running clearance between a cutter blade tip and the basket or inlet tube is maintained, a relatively high frequency of jamming of solid objects between the macerator blade and the basket of inlet tube occurs. Such jamming renders the macerator inoperable.

The Applicants have hypothesized that if a larger blade tip running clearance were provided, with a gradual reduction in the running clearance, solid objects drawn into the gap between the macerator blade and the basket or inlet tube would be macerated, taken in by the pump, and discharged in the desired routine manner. Subsequent experimental testing confirmed this hypothesis. In accordance with the invention, therefore, a macerating apparatus for a toilet is provided in which the problem of jamming the macerator by solid objects is solved by providing a larger blade tip running clearance and a gradual reduction in the running clearance at the junction of the macerator basket and the inlet tube. In certain embodiments, the macerating apparatus may be comprised of a macerating cutter operatively connected to a motor and disposed within a macerating basket, and an asymmetric inlet tube joined to the macerating basket, which is configured to providing the larger blade tip running clearance and gradual reduction in the running clearance at the junction of the macerator basket and the inlet tube.

The intake basket may be comprised of a cylinder comprising a wall surrounding the cutter, with the inlet tube intersecting the wall of the cylinder. The cutter may be a rotary cutter with the cutting blade defining a plane of rotation, and wherein the asymmetry of the inlet tube is in a lower inward region of the inlet tube and in the plane of rotation of a cutting blade of the cutter. The asymmetry of the inlet tube may be biased toward the lower inward region of the inlet tube in the direction of rotation of the cutter. The increased operating clearance between the cutting blade of the macerating cutter and the intake basket may occur between about 50 and about 100 degrees of cutter rotation. This sector of rotation is biased relative to the inlet tube in the direction of rotation of the cutter, and aligns generally with the lower inward region of the inlet tube.

BRIEF DESCRIPTION OF THE DRAWINGS

The present disclosure will be provided with reference to the following drawings, in which like numerals refer to like elements, and in which.

Figure 1:
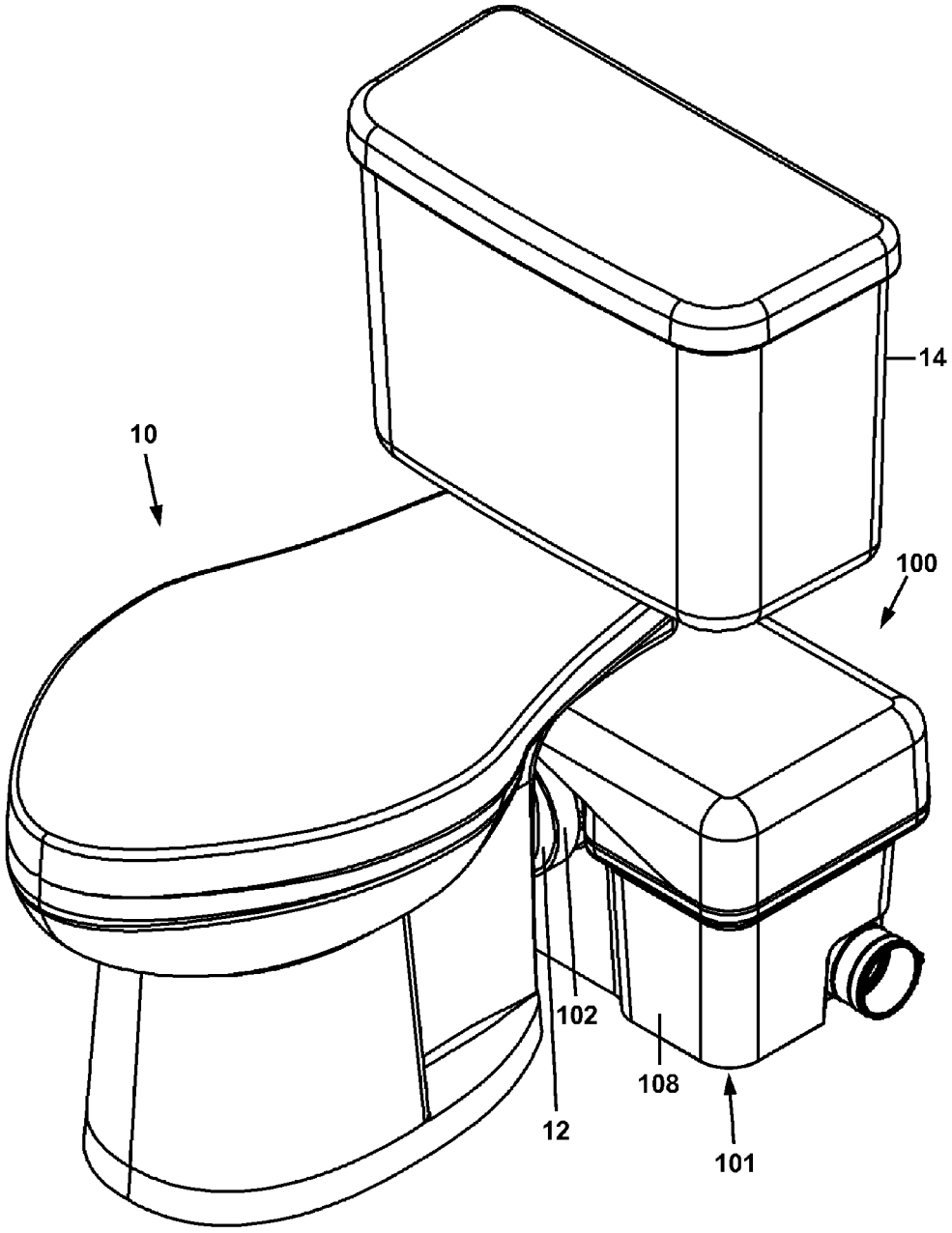
FIG. 1 is a front perspective view of the instant macerating apparatus connected to a toilet.

The present invention will be described in connection with certain preferred embodiments. However, it is to be understood that there is no intent to limit the invention to the embodiment described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. In the following disclosure, the present invention is described in the context of its use as a macerating apparatus for a toilet. However, it is not to be construed as being limited only to use in macerating the solids that may be present in an effluent stream from a toilet. The invention is adaptable to any use in which macerating of solids in a liquid stream is desirable to be provided from a macerating apparatus. Additionally, the description identifies certain components with the adjectives "front," "rear," "top," "upper," "bottom," "lower," "left," "right," etc. These adjectives are provided in the context of use of the macerating apparatus as connected to a toilet and in the context of the orientation of the drawings. The description is not to be construed as limiting the macerating apparatus to use solely in the spatial orientation shown herein. The instant macerating apparatus may be used in orientations other than those shown and described herein.

Figure 2:
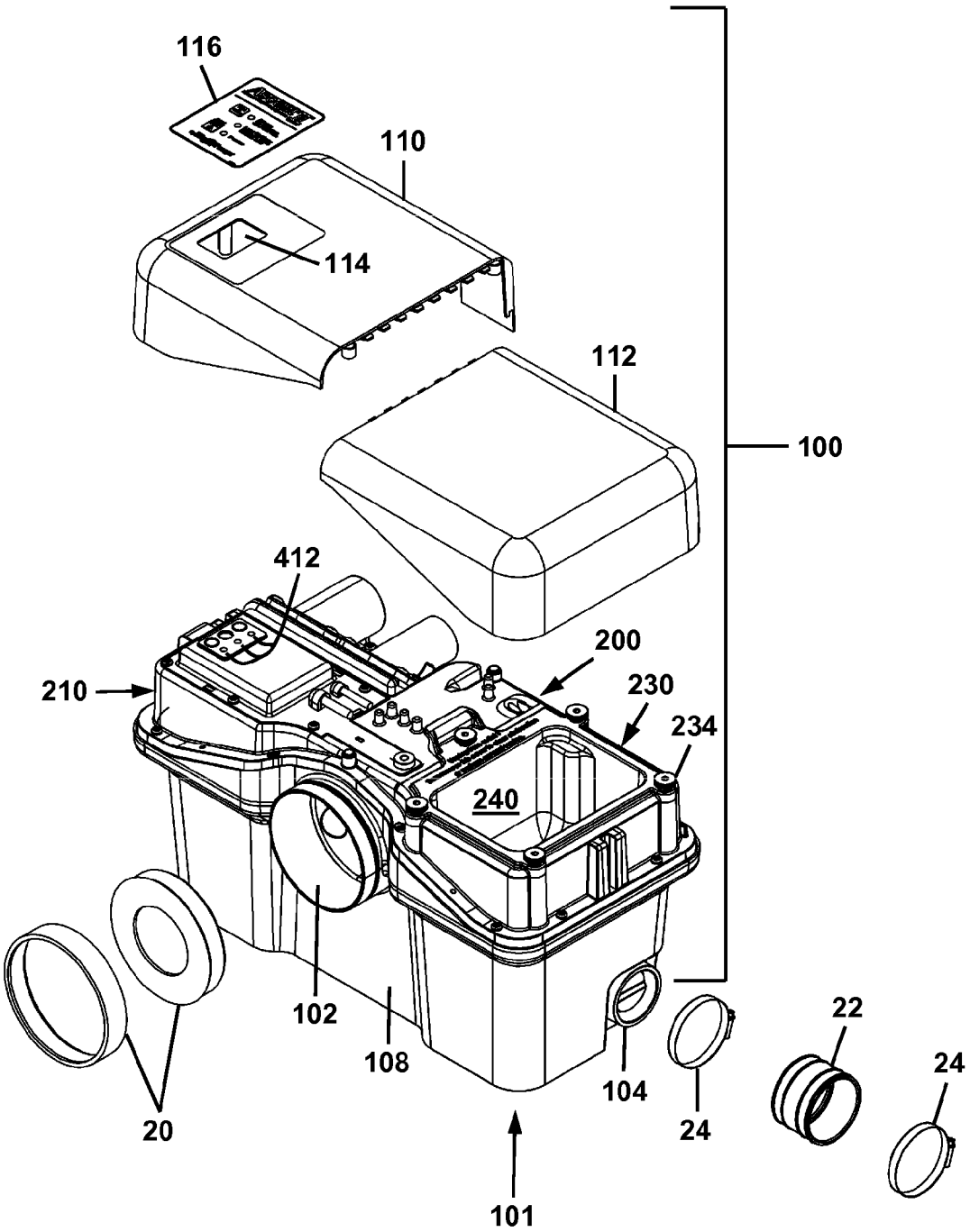
FIG. 2 is a front perspective view of the macerating apparatus in a first partially exploded state.

FIGS. 1 and 2 are perspective views of the instant macerating apparatus 100 connected to a toilet 10, and in a first partially exploded state, respectively. In certain embodiments, the apparatus 100 includes a tank 101, which may be connected at a first inlet port 102 to the effluent outlet 12 of the toilet 10. A length of pipe may be provided between the effluent outlet 12 of the toilet 10 and the tank 101 to permit the tank to be located behind a wall (not shown) adjacent to the toilet. The tank 101 may further include a second inlet port 104 and a third inlet port 106 (FIG. 10A). The first inlet port 102 is made sufficiently large and is positioned higher on the front wall 108 of the tank so as to match with the rear discharge port 12 of the toilet 10, and to pass the various solids contained in the liquid effluent that is discharged from the toilet 10. Gaskets 20 may be provided to seal the juncture between the inlet port 102 and the discharge port 12 of the toilet 10. One or both of the second and third ports 104 and 106 may be plugged. Alternatively, one or both of the second and third ports 104 and 106 may be connected to piping from sources of "gray water," by suitable means such as flexible pipe coupling 22 and hose clamps 24. Gray water sources may include sinks, bathtubs, showers, washing machines, and the like, wherein the effluent of such does not contain solids, and thus does not need maceration. Such solids-free effluent can simply be pumped out of tank 101 when a certain liquid level is reached therein.

The macerating apparatus may be provided with decorative removable covers 110 and 112, which provide a pleasing aesthetic appearance, while also providing isolation of the various components therebeneath. Cover 110 may include a window 114 for visibility of status indicating lights 412 (to be described subsequently herein) and a label 116 with indicia that correspond to the status lights 412. Covers 110 and 112 are easily removed by hand so as to provide simple access to the apparatus components beneath them.

Figure 3:
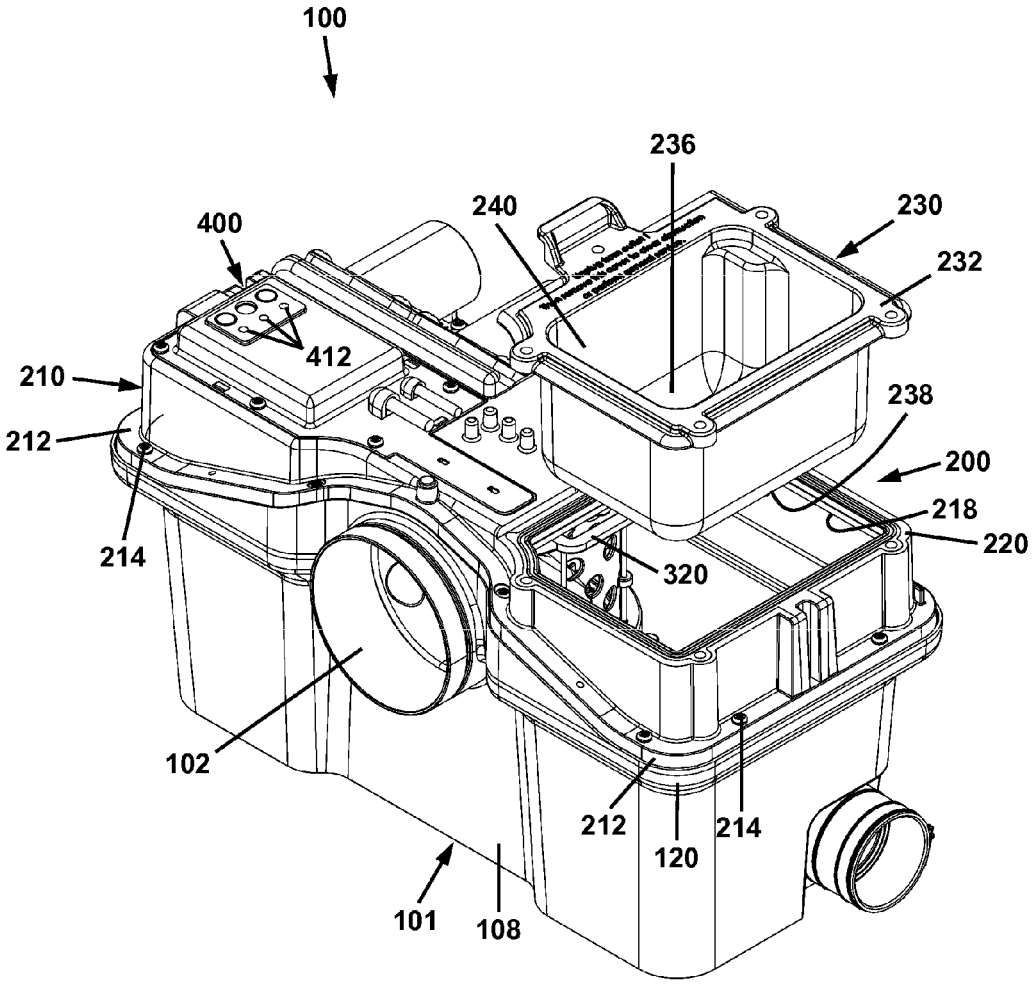
FIG. 3 is a front perspective view of the macerating apparatus in a second partially exploded state.
Figure 4:
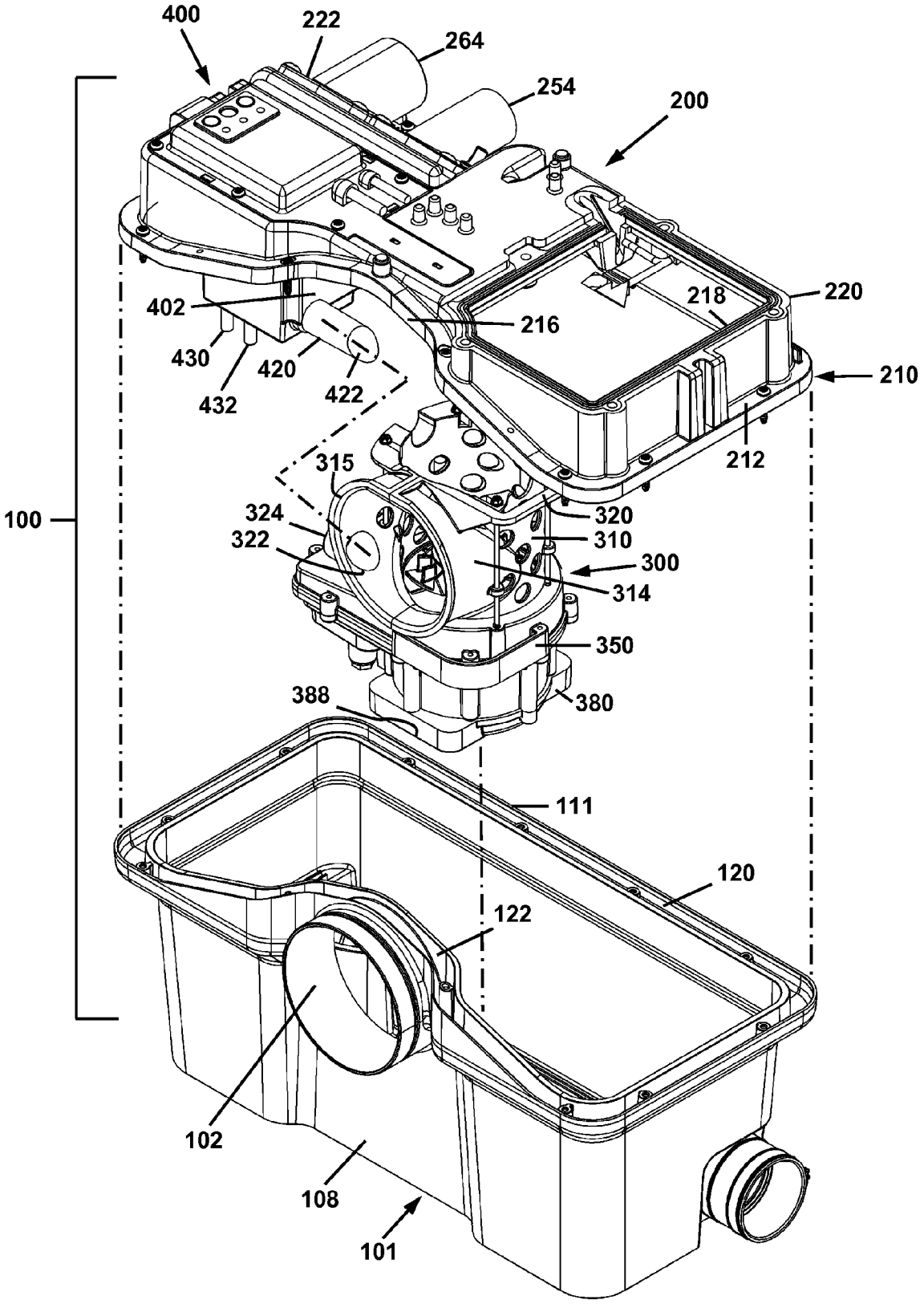
FIG. 4 is a front perspective view of the macerating apparatus in a third partially exploded state.
Figure 5:
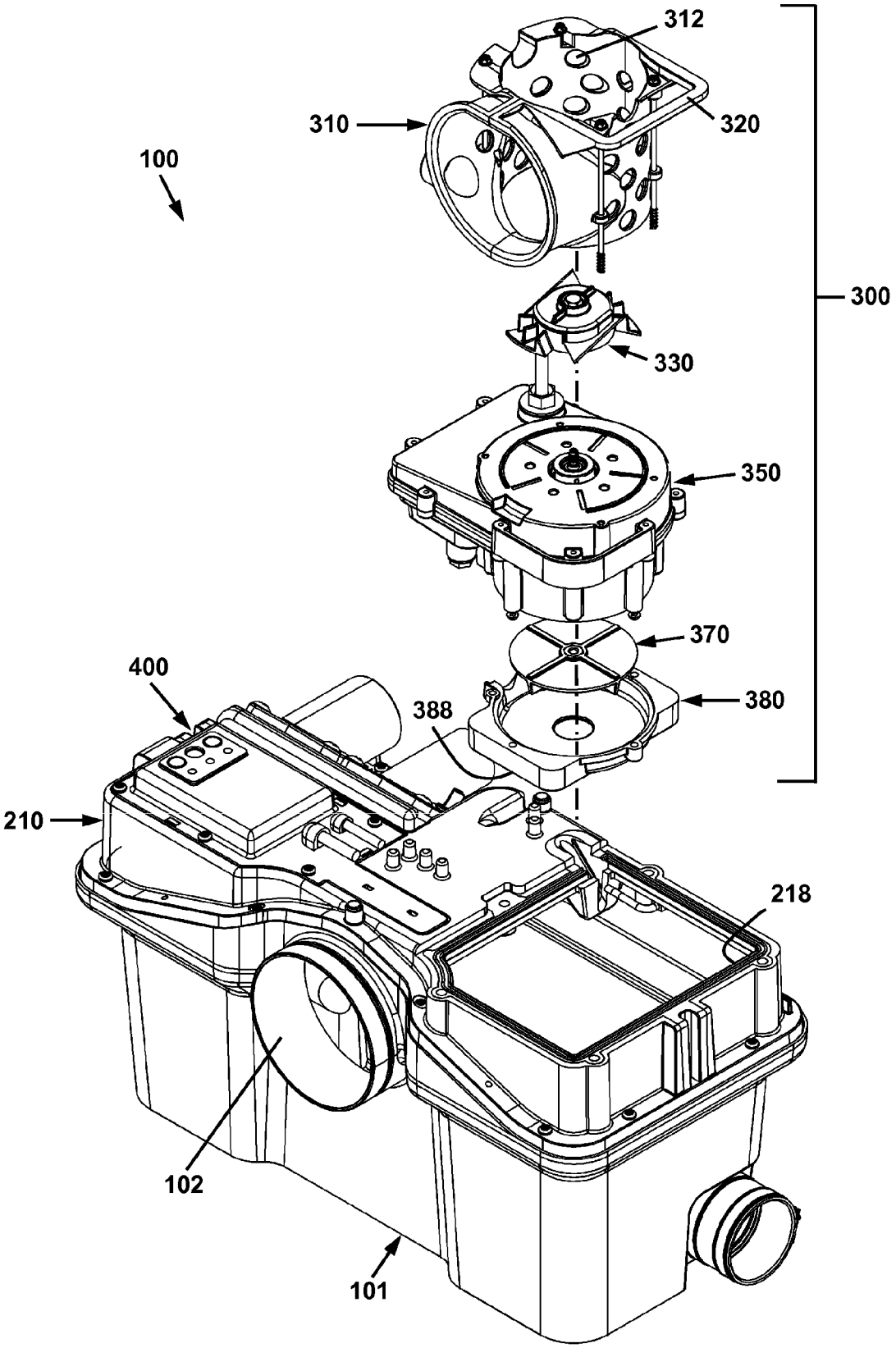
FIG. 5 is a front perspective view of the macerating apparatus in a fourth partially exploded state.

Referring also to FIGS. 3 and 4, which are additional exploded perspective views, the apparatus 100 may be further comprised of a cover assembly 200 fittable to the open top 111 of tank 101, a macerating unit 300, and a control module 400. The cover assembly 200 is comprised of a main cover 210 and an access cover 230. The main cover 210 may be provided with a flange 212 around the lower perimeter thereof for sealing to a corresponding flange 120 provided on the open top 111 of tank 101. A gasket (not shown) may be disposed between the flanges 212 and 120, with the flanges being removably joined together by suitable fasteners 214. The front portion of the flange 212 may be formed with a riser section 216 which corresponds to the riser section 122 of the flange 120 of tank 101. These riser sections accommodate the provision of the intake port 102 at a high location on the tank wall 108 for a straight transition from the toilet outlet 12 into the intake screen of the macerating unit 300.

The access cover 230 is fitted to an opening 218 in the main cover, and is provided with a flange 232 which corresponds with and seals to a flange 220 in the main cover 210, in the same manner as described for main cover flange 212 and tank flange 120. The access cover 230 is made easily removable from the main cover 210 by threaded fasteners 234. Other quick-release fastening means such as e.g., clamps, quarter-turn fasteners, and the like are contemplated.

The access cover 230 is formed with a downwardly extending cavity 236 having a bottom wall 238 and side walls. The side wall 240 that is proximate to the macerating unit 300 serves the purpose of holding the macerating unit 300 in its operating position when the access cover 230 is joined to the main cover 210, as will be explained in further detail herein. Alternatively, the access cover 230 could be provided as a simple flat cover with a downwardly extending portion that contacts the macerating unit 300 and retains it in its operating position.

Figure 11A:
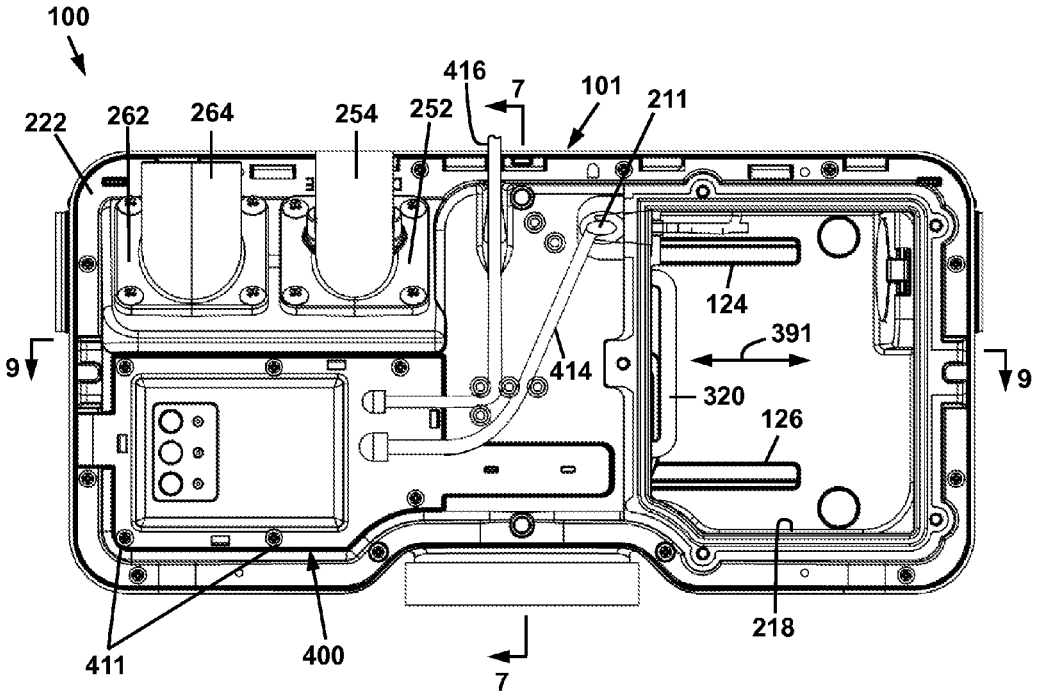
FIG. 11A is a first top view of the macerating apparatus with the decorative covers and an access cover removed, and with the macerating unit in an operational position.
Figure 12:
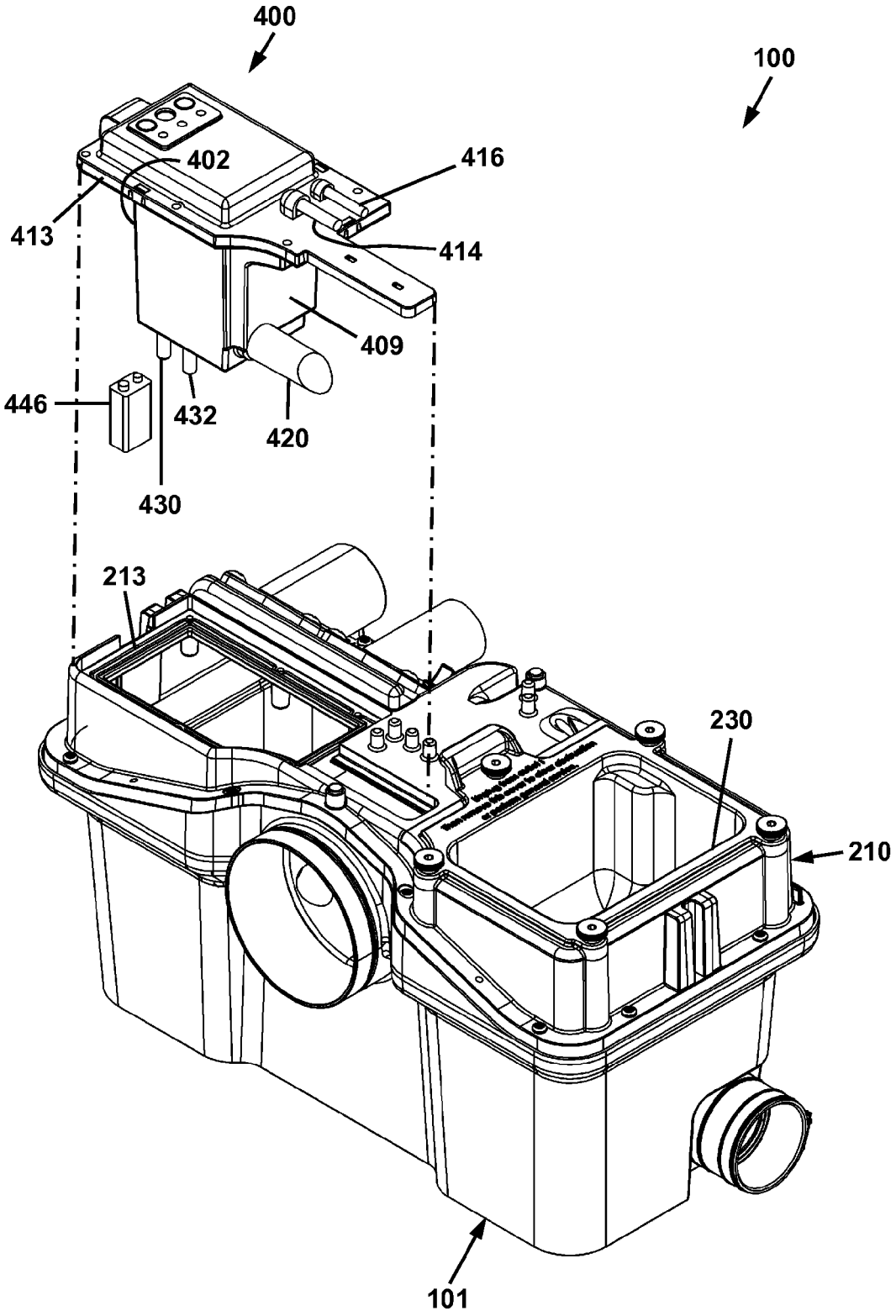
FIG. 12 is a perspective view of the macerating apparatus in a fifth partially exploded state.

Referring now to FIGS. 4-9, the macerating unit 300 is comprised of an intake basket 310, a cutter cartridge 330, a motor enclosure 350 containing a motor 360, an impeller 370, and a volute 380. Referring also to FIG. 11A, the motor is provided with electrical power through a flexible cord 414 from the control module 400, which in turn is supplied with electrical power through a cord 416, which may include a plug (not shown) for connection to a wall socket (not shown). The cords 414 and 416 may be routed through and secured with pegs which protrude from the main cover 210. The flexible cord 414 may be routed through a cord seal 211 that is similar to the cord seal disclosed in commonly owned U.S. Pat. No. 7,563,082, the disclosure of which is incorporated herein by reference. Referring also to FIG. 12, the control module 400 may be removably joined to a control opening 213 in the main cover. The control module 400 may include a flange 413 which is seated on a seal and joined by fasteners 411 to flange 413 in the main cover 210, in a manner similar to that described previously for the access cover 230. (It is noted that in FIG. 12, for the sake of simplicity of illustration, only a small portion of cords 414 and 416 are shown extending form the control module 400.)

Figure 13B:
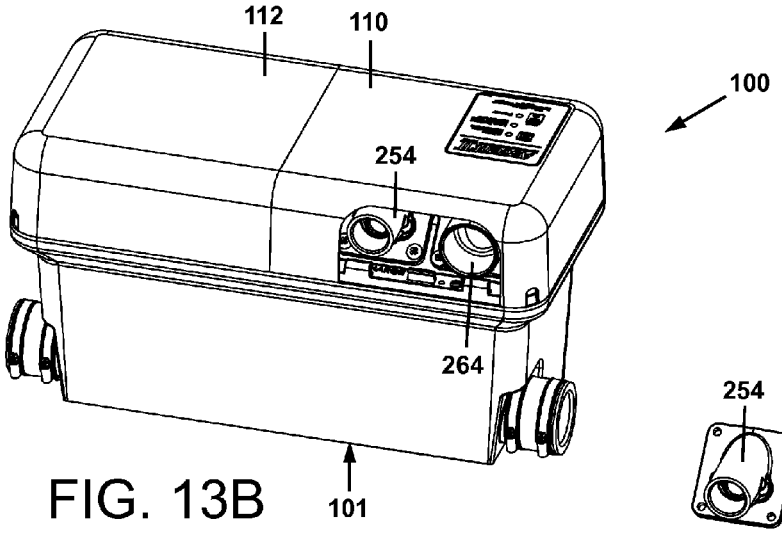
FIG. 13B is a rear perspective view of the macerating apparatus shown with piping connections assembled with the apparatus in a first orientation.
Figure 13A:
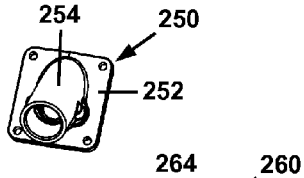
FIG. 13A is a rear perspective view of the macerating apparatus shown with piping connections disassembled from the apparatus.
Figure 13A:
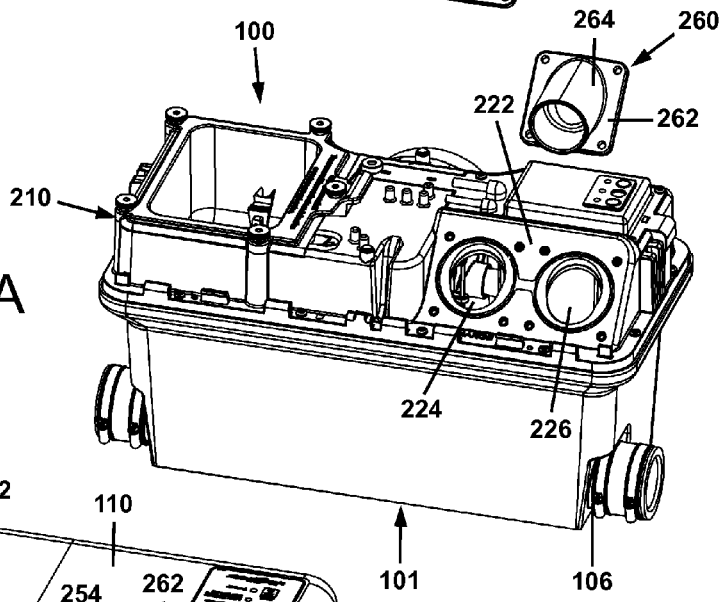

In operation, the motor 360, intake basket 310, and cutter cartridge 330 coact to macerate solid materials in the incoming liquid effluent stream from the toilet 10. Simultaneously, the motor 360, impeller 370, and volute 380 coact to pump liquid slurry that has been macerated by the cutter cartridge 330. Such slurry flows downwardly through holes 312 in the basket 310 to the bottom of the tank 101, into the inlet 382 of the volute as indicated by arrows 399, out through the outlet 384 of the volute 380 as indicated by arrow 398, through a conduit (not shown) within the tank 101, and out through an outlet fitting 254 (FIG. 13A).

Figure 6:
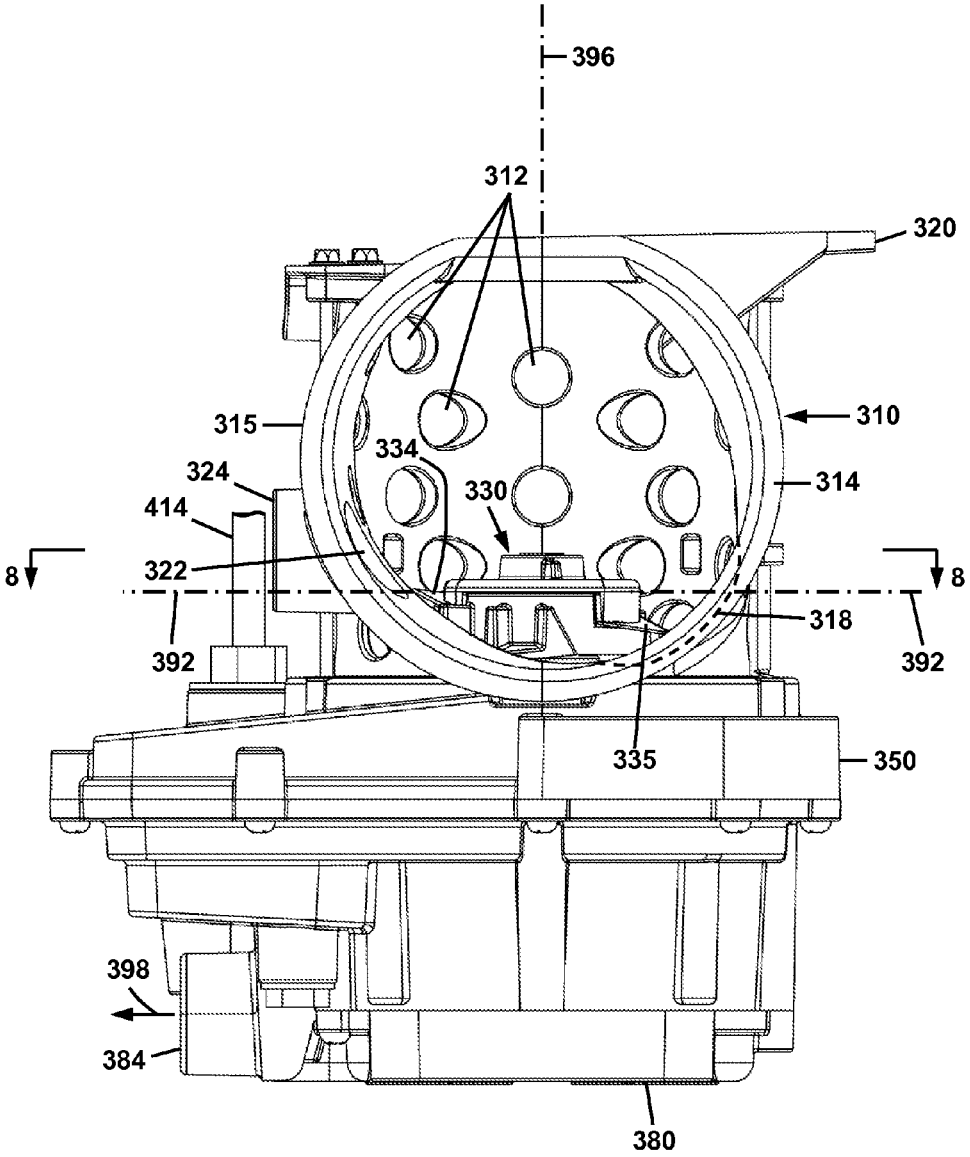
FIG. 6 is a front elevation view of the macerating unit of the macerating apparatus.
Figure 9:
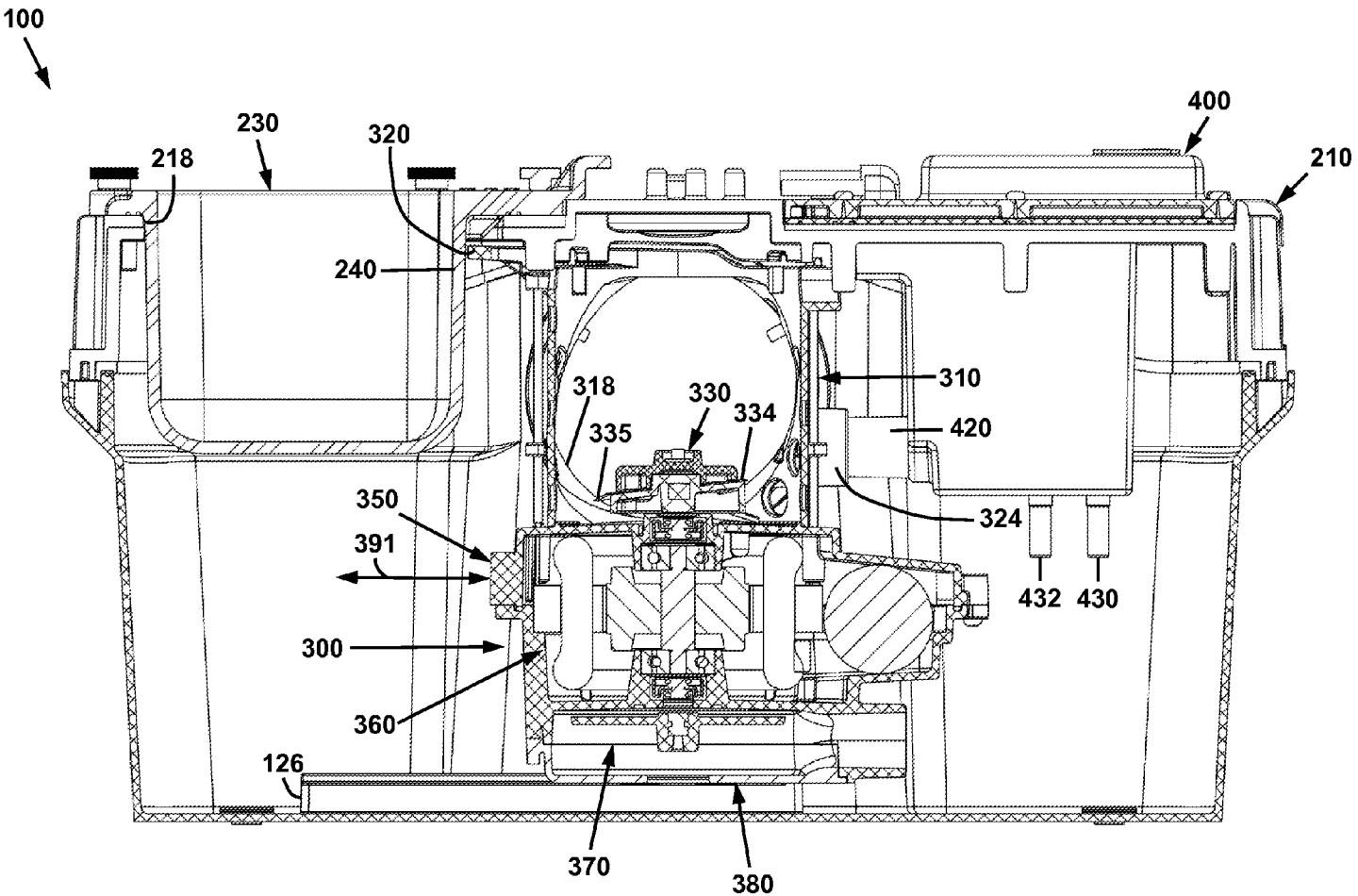
FIG. 9 is a rear cross-sectional view of the macerating unit within the tank of the macerating apparatus in the operational position, taken along line 9-9 of FIG. 11A.
Figure 10:
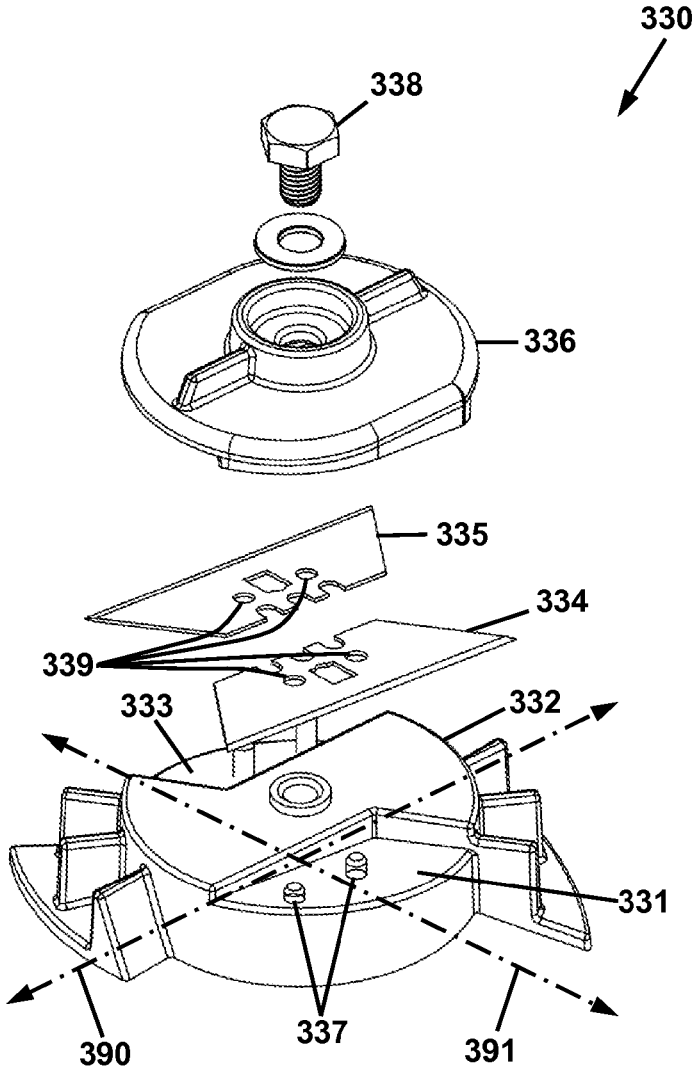
FIG. 10 is a detailed exploded view of one embodiment of a cutter cartridge of the macerating unit.

Referring also to FIG. 10, the cutter cartridge 330 may be comprised of a base 332, at least one cutter blade 334, a cap 336, and a fastener 338 which secures the cap 336 and the blade 334 to the base 332. The rotary motion of cutter blade 334 defines a plane of rotation 392 (see also FIG. 6) denoted by orthogonal axes 390 and 391. The base 332 and/or the cap 336 may be provided with a recess formed therein to receive the blade 334, thus holding it firmly when in operation, thereby helping to prevent breakage thereof. In the embodiment depicted in FIG. 10, the cutter cartridge 330 is comprised of first and second cutter blades 334 and 335. Other cutter configurations are contemplated, such as having more than two blades, or a single blade having multiple cutting teeth extending radially therefrom in a star or saw tooth pattern. In one preferred embodiment, cutter blades 334 and 335 are identical, and are standardized trapezoid-shaped utility knife blades sold in retail hardware stores, thereby facilitating procurement of inexpensive replacement blades for the user of the apparatus. In the embodiment depicted in FIG. 10, the base 332 is provided with formed recesses 331 and 333 for receiving the cutter blades 334 and 335. Pins 337 may be provided for engagement with holes 339 in the blades 334 and 335 to hold them securely in place. Referring to FIGS. 6, 9 and 10, the recesses 331 and 333 may be angled with respect to the plane of rotation 392, such that the first and second cutter blades 334 and 335 mounted respectively thereupon are canted at an angle that is non-parallel to the plane of rotation 392.

In certain embodiments, the macerating unit may be comprised of features that provide enhanced macerating capability. This is best understood with reference to FIGS. 6, 8, and 9. The Applicants have discovered how to provide enhanced macerating capability through observations and experimental trials. In one initial embodiment (not shown) of the macerating apparatus 100, a cylindrical inlet tube was joined to a cylindrical intake basket in the macerating unit 300, with the central axis 397 of the tube and the central axis 396 of the basket being substantially perpendicular to each other. In this configuration, the tips of the cutter blades were maintained at a relatively narrow clearance 311 with the inner wall 316 of the basket 310, except for a small region indicated by arcuate bidirectional arrow 395 in FIG. 8. It was discovered that solid objects tended to jam one of the cutter blades 334 and 335 in this configuration, with a given solid object becoming jammed between the tip of the cutter blade and the inner wall 316 at the point where cutter tip-to-wall clearance decreased.

To solve this problem, an asymmetric inlet tube 314 in communication with the intake basket 310 was discovered to be effective. Rather than being cylindrical, the inlet tube 314 is asymmetric in that it has a biased opening in the lower region 318 thereof, in FIG. 8 between approximately the 7 o'clock position 394 and the 4 o'clock position 393. Rather than being cylindrical, this region 318 extends further laterally as indicated by dotted line 318 in FIG. 6. In that manner, when the cutter blades 334 and 335 are rotating, the tip clearance with any nearby basket 310 and inlet tube 314 wall surfaces is increased near region 318, i.e. from approximately the 7 o'clock position 394 to the 4 o'clock position 393 of FIG. 8, and a more gradual transition to the narrow tip-to-wall running clearance 311 occurs. Generally, an increased blade tip running clearance is desired over about 50 and about 100 degrees of cutter rotation near region 318. The Applicants have discovered that with this configuration, the incidence of cutter jamming is greatly reduced, and the macerating cutter 330 is much more effective at slicing through solid objects that are carried by the liquid effluent from a toilet.

Figure 11B:
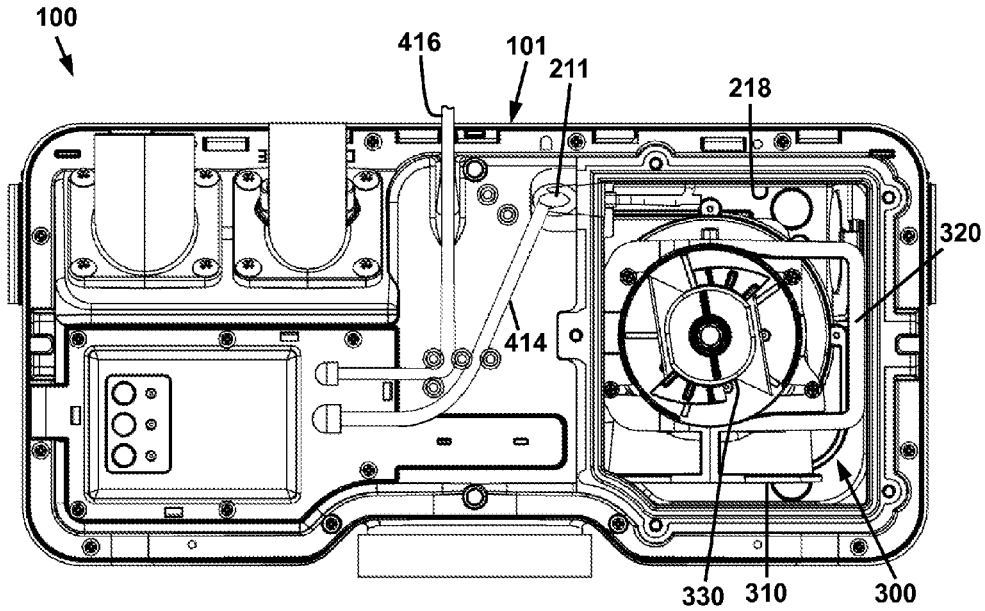
FIG. 11B is a second top view of the macerating apparatus as shown in FIG. 8A, but with the macerating unit in a maintenance position.

In certain embodiments of the Applicants' macerating apparatus, the problem of unsanitary and/or difficult maintenance of the macerator is solved by providing a modular macerating unit that is easily moved to a convenient maintenance position, and if necessary, easily removed from the toilet tank. Referring in particular to FIGS. 3, 4, and 9, the macerating apparatus 100 may be comprised of a tank 101 having an open top 111, a macerating unit 300 disposed in the tank 101, and a main cover 210 joined to the open top 111 of the tank 101. The main cover 210 includes an opening 218 for access to the macerating unit 300 and other components therein. Referring also to FIGS. 9, 11A, and 11B, the macerating unit 300 is movable as indicated by bidirectional arrow 391 between an operating position shown in FIGS. 9 and 11A, and a maintenance position shown in FIG. 11B. From the maintenance position, the macerating unit may be removed from the tank 101 through the opening 218 in the main cover 210.

Referring also to FIGS. 3-6, the macerating unit 300 may be provided with a handle 320 for the user to grasp in order to facilitate movement between the operating position and the maintenance position. The handle may be joined to the macerating unit 300 in the upper region thereof, such as to the intake basket 310. In this configuration, advantageously, the apparatus 100 may be further comprised of an access cover 230 fittable to the opening in the main cover 210 and extending downwardly within the tank 101. A downwardly extending portion of the access cover 230, such as cover wall 240 contacts the handle 320 (or another part of the macerating unit 300 similarly arranged), thereby holding the macerating unit 300 in its operating position when the access cover 230 is fitted to the main cover 210.

Figure 7:
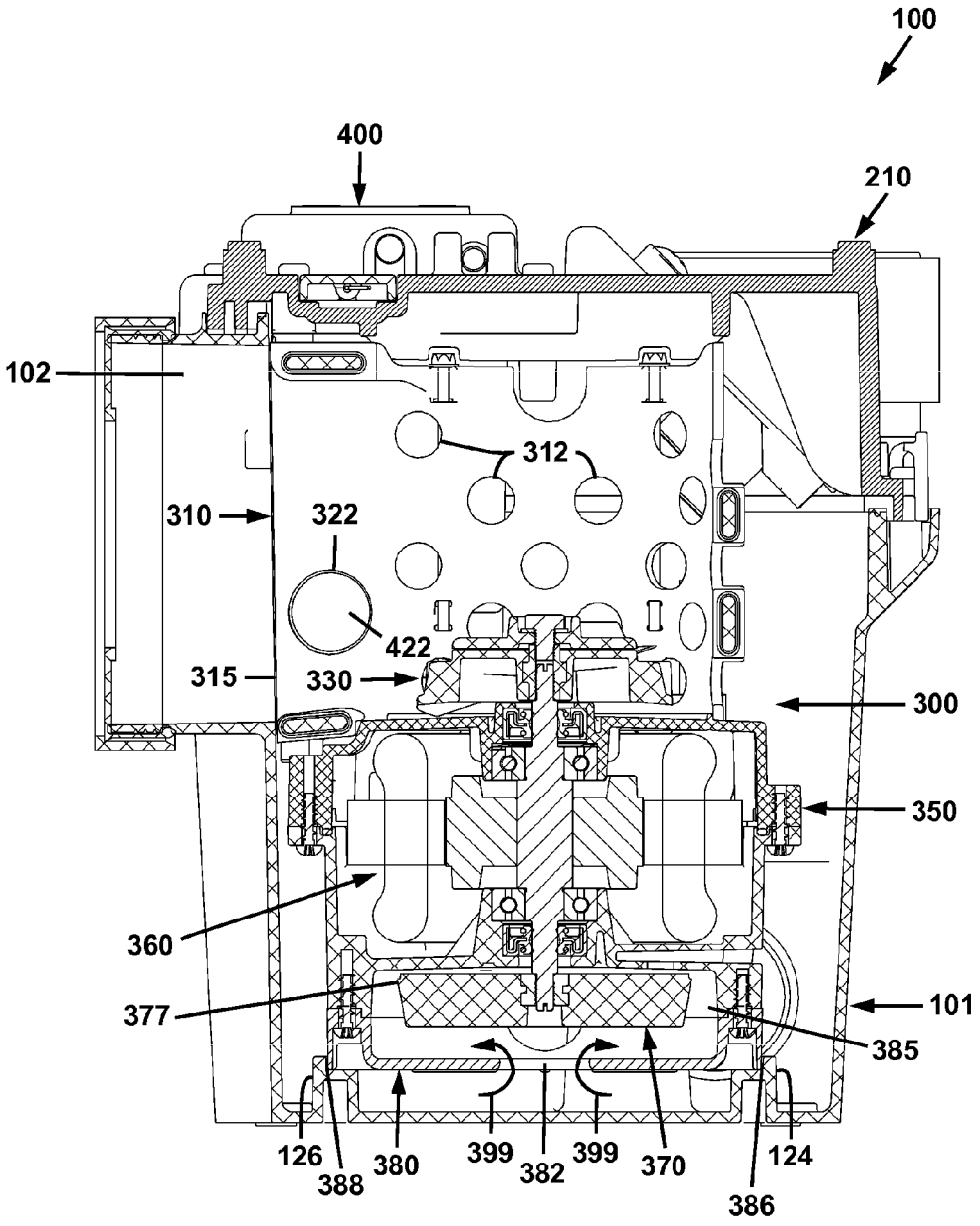
FIG. 7 is a side cross-sectional view of the macerating unit of FIG. 6 disposed within the tank of the macerating apparatus in an operational position, taken along line 7-7 of FIG. 11A.

Additionally, referring also to FIG. 7, the macerating unit 300 may be disposed in a track on the bottom surface of the tank 101. The track may be comprised of first and second guide rails 124 and 126 which are joined to or integrally formed in the bottom of tank 101. The guide rails 124 and 126 may have L-shaped cross sectional shapes, which receive the lower corner edges 386 and 388 of the pump volute 380. In that manner, the guide rails 124 and 126 guide the motion of the macerating unit between the maintenance position and the operating position, and also coact with the access cover 230 in contact with the handle 320 to firmly hold the macerating unit 300 in its operating position during operation, and particularly during startup, when high torque loads on the macerating unit 300 occur.

In addition to providing a macerating unit 300 with an inlet basket configured to avoid jamming of the cutter cartridge 330 with solid objects, in certain embodiments, the macerating apparatus 100 is provided wherein the aforementioned problem of jamming the macerator at startup is solved by rapidly detecting the flushing of the toilet and accelerating the macerator before potentially motion jamming solid objects in the effluent from the toilet can reach it.

The macerating apparatus 100 may be comprised of a macerating cutter operatively connected to a motor, and a sensor in communication with the motor. The sensor may detect the flow of effluent from the toilet toward the macerator, the flow of makeup water from the supply tank into the toilet, or the mechanical action of the mechanism used to flush the toilet. The sensor detects the toilet flushing at the beginning or early in the toilet flushing cycle and causes the motor to start and operate the macerating cutter before the effluent containing solid objects contacts the macerating cutter.

In one embodiment depicted in FIGS. 4, 7, and 9, a sensor 420 may be provided in the intake basket 310 of the cutting cartridge. The sensor 420 may be located as far upstream in the basket 310 as possible, i.e. toward the outer edge 315 of the inlet tube 314. A port 322 may be provided in the inlet tube 314 for the sensor to extend through so as to contact the solids-containing liquid effluent that flows when the toilet is flushed. The port 322 may be provided with a fitting 324 for securely receiving and guiding the fitting to its operating location. The port 322 is preferably located toward the bottom of the inlet tube 314. In that manner, even if a toilet flush does not result in a fully flooded inlet tube 314, and the inlet tube 314 is less than half full, the sensor 420 will still be flooded during the start of flush and detect the start of flush. The tip 422 of the sensor 420 may be beveled to conform to the shape of the inner wall of the inlet tube 314, so as to not obstruct the inlet tube 314 and cause solids to accumulate there.

The sensor 420 may be a capacitance sensor, which detects a change in capacitance when flooded with effluent, and then again when the effluent recedes. Alternatively, the sensor 420 may sense conductivity, flow, pressure, or any other physical property that varies when the inlet tube 314 is flooded with effluent and then recedes. Referring to FIGS. 4 and 9, the sensor 420 may be integrated into a control module 400, and extend into the inlet tube 314 from a wall 409 of a housing 402 of the module 400. In another embodiment (not shown), the sensor 420 may be joined to a cable that extends through the port 322 in the inlet tube 314, and forwardly past the outer edge 315 of the inlet tube 314 into the pipe coupling to the toilet 10 or into the outlet from the toilet 10. In that manner, the sensor 420 is placed even further upstream for early flush detection.

Other means for rapidly detecting the flushing of the toilet 10 may be provided instead of the sensor 420. In one embodiment (not shown), a sensor may be provided which detects the flow of makeup water from the supply tank 14 (FIG. 1) into the toilet 10, or the initial drop in level of makeup water in the supply tank when a flush is started. In another embodiment (not shown), a sensor may be provided which detects the motion of the flapper valve in the supply tank 14 (FIG. 1) into the toilet 10. The sensor may be, for example, an accelerometer sensor on the flapper valve or on the chain from the flush handle to the flapper valve, or a load cell on the chain from the flush handle to the flapper valve. In another embodiment (not shown), a sensor may be provided which detects the motion of the toilet flush handle on the supply tank 14 (FIG. 1), such as a tilt switch on the flush handle or the internal toilet flush rod. In another embodiment (not shown), a sensor may be provided which detects the sound or vibration from water turbulence or another noise associated with the flushing of the toilet 10. Any of these sensors may be in direct hardwired communication with the control module 400, or they may be provided with wireless communication to control module 400.

Figure 8:
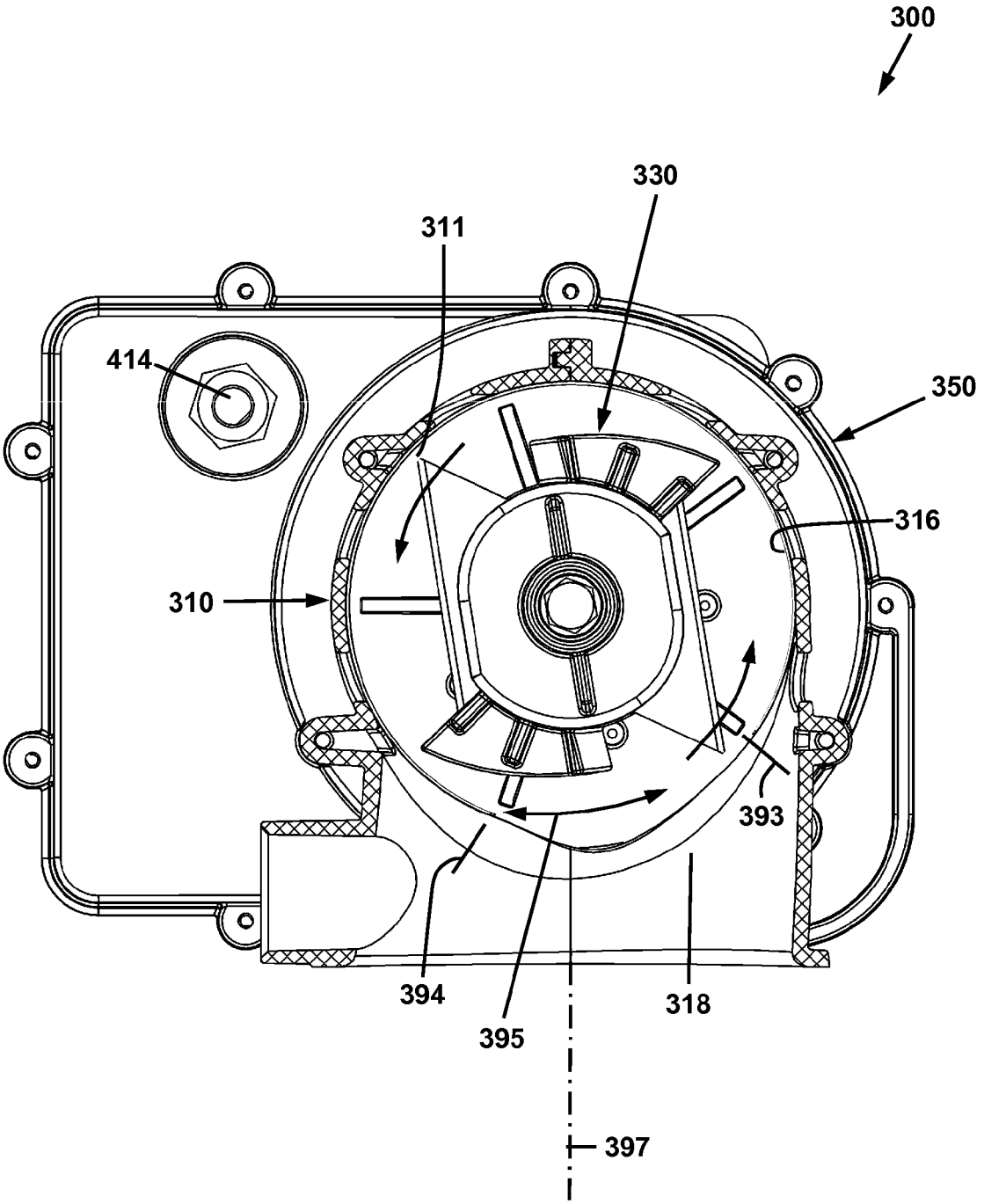
FIG. 8 is a top cross-sectional view of the macerating unit of FIG. 6, taken along line 8-8 of FIG. 6.

The use of the Applicants' macerating apparatus comprising means for detecting flushing of the toilet before effluent discharged from the toilet contacts the macerating cutter enables a method of macerating an effluent stream from a toilet. The method comprises detecting flushing of the toilet 10 that causes the effluent stream, and starting a macerating unit 300 comprising a macerating cutter 330 operatively connected to a motor 360, and accelerating the macerating cutter 330 using suitable means such as motor 360, to an operating speed prior to the effluent stream reaching the macerating cutter 330. As used herein, "rapidly detecting the flushing of the toilet" means detecting the flushing sufficiently early so as to accelerate the macerating cutter 330 to a sufficient operating speed that prevents jamming of the cutter with solid objects in the effluent stream. The amount of time needed to accelerate the cutter to a sufficient operating speed before solid objects arrive (i.e. how much in advance the flush must be detected before solid objects arrive at the cutter blades) varies depending upon the horsepower of the motor and its acceleration capability, the configuration of the cutter, the sharpness of the cutter blades, and the configuration of the toilet and flush tank. However, based upon experimental data for one embodiment of the apparatus 100, detecting the flushing and triggering the motor to start at least about 0.5 second in advance of solid objects arriving at the cutter blades has been found to be effective in a macerating unit 300 having a 0.5 horsepower motor and a cutter cartridge 330 as shown in FIGS. 8 and 10 and described herein.

Figure 14:
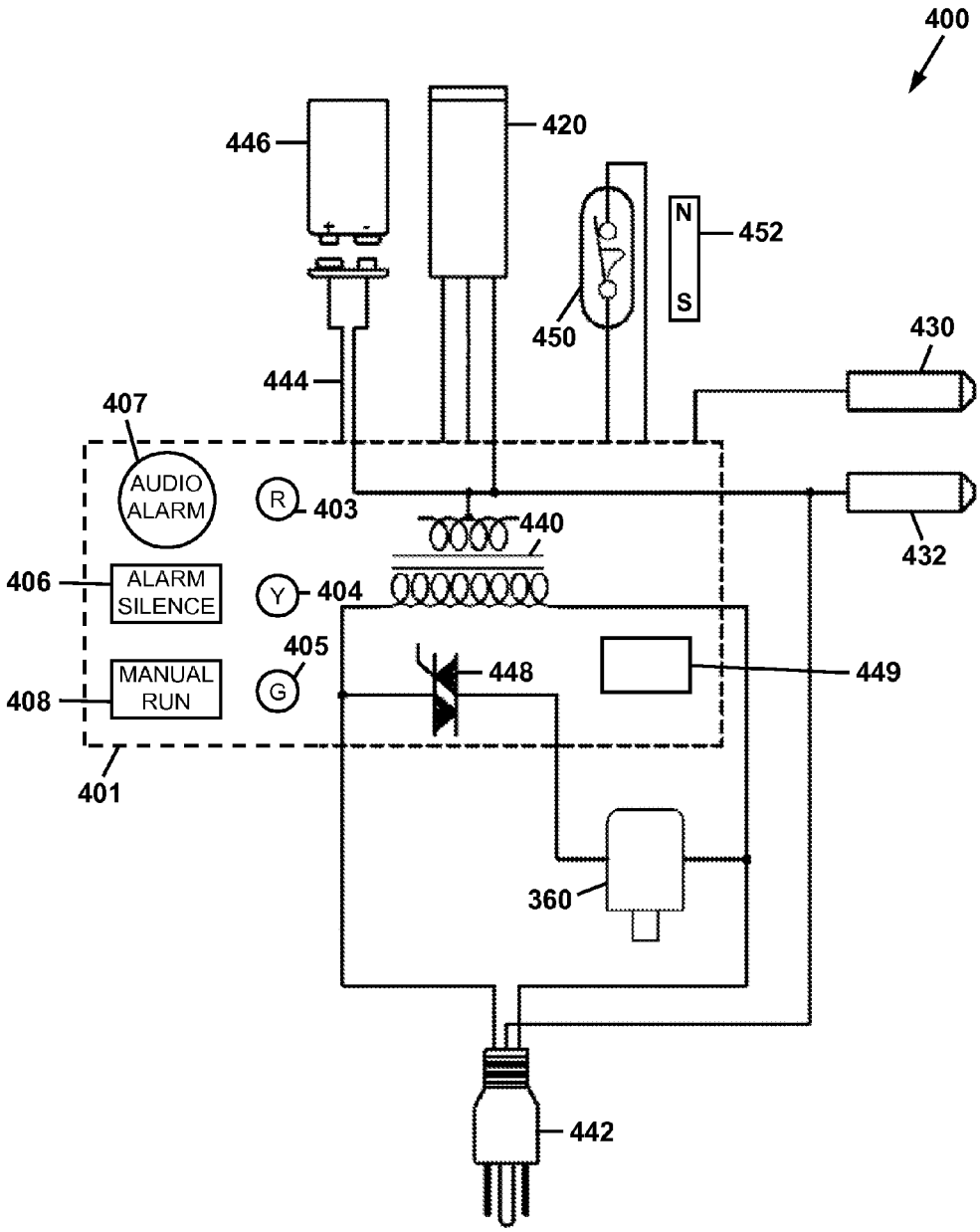
FIG. 14 is a schematic diagram of electrical components and controls for certain embodiments of the Applicant's macerating apparatus.

The macerating apparatus 100 may be provided with multiple sensors for control of the macerating unit 300. Referring to FIGS. 4, 12, and 14, an additional sensor 430 may be provided. The sensor 430 detects the presence of liquid in the tank 101. A second sensor (not shown) may be provided as a backup sensor. The sensor 430 may be a conductivity sensor, which is referenced to a ground electrode 432. The sensor 430 and ground electrode 432 may be integrated into the housing 402 of the control module 400, extending downwardly as shown, or laterally therefrom. The macerating apparatus may have two modes of automatic operation. In the first mode, gray water may enter the tank 101 through one or both of the second and third ports 104 and 106 (FIG. 13A), causing the level of liquid in the tank 101 to rise. When the level reaches sensor 430 and is detected, the motor 360 is started, and the pump (impeller 370 and volute 380) act to pump the liquid out of the tank 101. In the second mode, when the sensor 420 or other early flush detection means detects the flush of the toilet, the motor 360 is started, and the macerating intake basket 310 and cartridge 330 act to macerate any solids contained in the effluent from the toilet. Simultaneously, the liquid slurry in the tank 101 is pumped out by impeller 370 and volute 380.

Given the content of the effluent stream from the toilet, and the content of the macerated slurry within the tank 101, sometimes one of the sensors in a macerating apparatus may become fouled, and disrupt the operation of the apparatus. A malfunctioning sensor can cause the apparatus to become inoperable, and thus the toilet connected to it to become inoperable. To solve the problem of fouled sensors disrupting macerator operation, the Applicants' macerating apparatus 100 may be provided with an adaptive control system. Referring again to FIG. 14, the control module 400 may include a circuit board 401 which contains process control circuits (not shown), status indicators such as an audio, i.e., audible alarm 407, red, yellow, and green indicator lights 403, 404, and 405, an alarm silence button 406, and a manual run button 408. The control module 400 may also include a transformer/converter 440 which drops the standard AC line voltage supplied through plug 442 to 5 volts DC for powering the various sensors and the control electronics, a connector 444 for connection to a backup battery 446, a triac 448 for controlling voltage to the pump/macerator motor 360, and a central processing unit 449 for integrating all of the control functions in one processor. For safety, a shutoff switch, such as a magnetically operated reed switch 450 may be provided, with a magnet attached to the removable cover 110, such that if the removable cover 110 is removed, the apparatus 100 is shut down. One function of the yellow alarm light 404 may be to warn of a low backup battery voltage.

Figure 15:
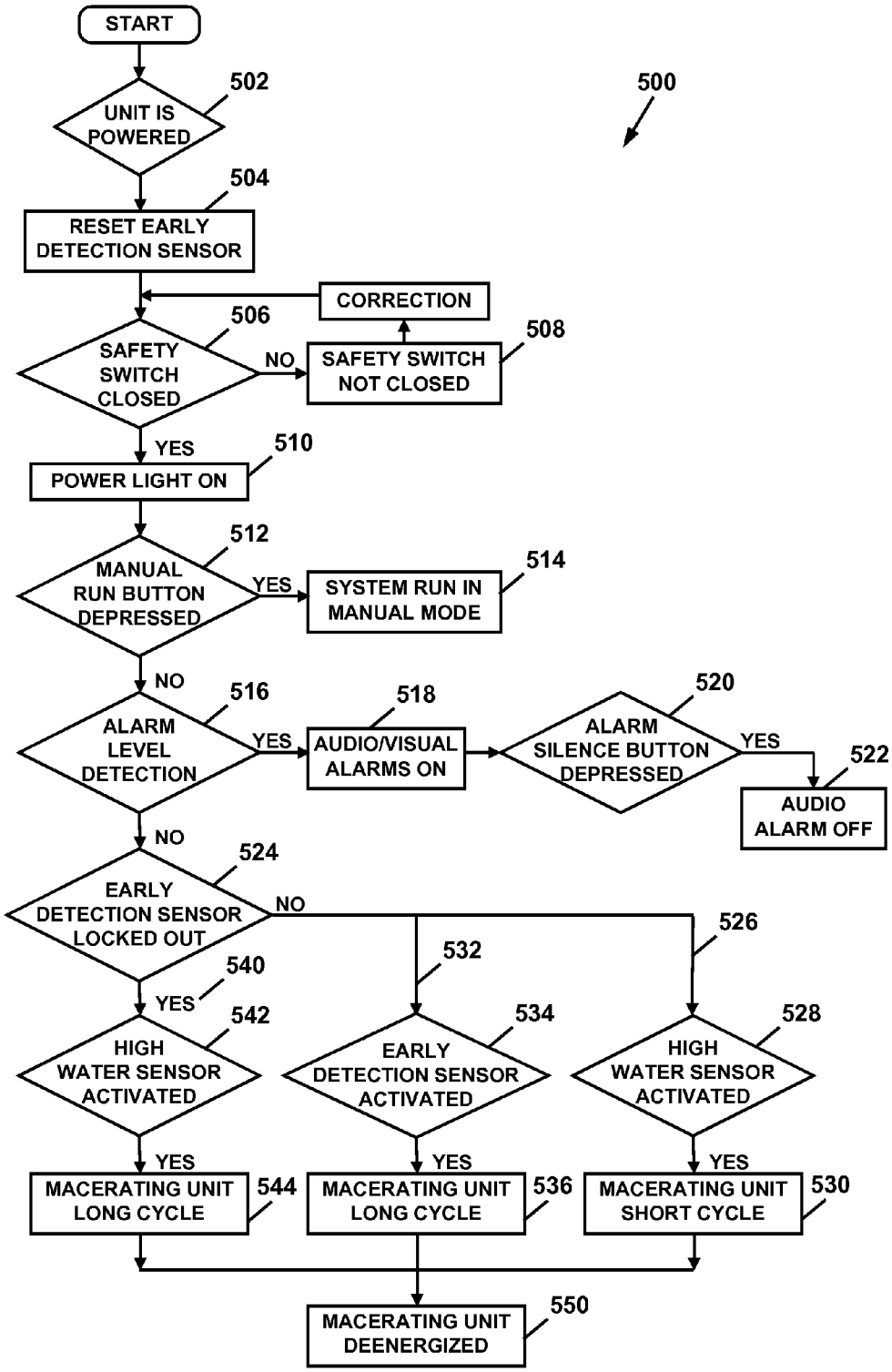
FIG. 15 is an exemplary logic diagram of one mode of operation of the macerating apparatus.

Referring now to FIG. 15, one example of the operation 500 of the apparatus 100 with adaptive controls is shown. The operation 500 shown is to be as exemplary, with other alternatives being suitable. When the apparatus 100 is first started up, and line voltage is applied 502 through plug 442, the control module 400 resets 504 the early flush detection sensor 420. The safety switch 450 is confirmed as being closed, i.e. the protective cover 110 is present. If the safety switch 450 is not closed 508, the condition must be corrected for the apparatus 100 to operate. The power (green) light 405 is illuminated 510.

At this point, the apparatus may be operated manually by pressing 512 the manual run button 408, such as for a startup check or for diagnostic purposes. In this mode, the motor 360 will run 514 for as long as the run button 408 is depressed, or until a thermal overload (not shown) or other safety circuit in the motor 360 shuts it down. During ongoing operation of the apparatus 100, the alarm level sensor 430 is checked 516 for an alarm condition, such as the sensor 430 having detected a high liquid level condition for more than a predetermined length of time, which would indicate a malfunction of the apparatus 100. In one exemplary embodiment, the length of time is about 7 seconds. If an alarm condition is present, the audible alarm 407 is sounded and/or the warning (red) light 403 is illuminated 518. For the convenience of a user, the audible alarm 402 may be silenced 522 by depressing the alarm silence button 406.

Also during ongoing operation of the apparatus 100, the early flush detection sensor 420 is checked to confirm that it is operable. If the sensor 420 is operable, in the aforementioned first mode 526 of operation, if the high water sensor 430 is actuated 528, such as by an inflow of gray water as described previously, the pump motor 360 is actuated 530 for a short time, such as about 5 seconds, thereby discharging the contents of the tank 101. A relatively short run time is sufficient, since the gray water contains no solids, and no work is being done by the macerating cartridge to cut solids. At the end of the run time, the pump motor 360 is deenergized 550.

With the sensor 420 being confirmed as operable, in the aforementioned second mode 532 of operation, if the sensor 420 detects 534 a flush of the toilet 10, the pump/macerator motor 360 is actuated 536 for a longer time, such as about 10 seconds. The longer time as compared to the first mode of operation is necessary to ensure that all solids that enter the macerating intake basket 310 are fully macerated by the macerating cutter 330 into a slurry that can be handled by the pump impeller 370 and volute 380. At the end of the run time, the pump motor 360 is deenergized 550. In one embodiment of the apparatus 100, the control module 400 monitors the load of the cutter on the motor and varies the run time depending upon the load on the cutter. The run time is increased for as long as necessary to fully macerate the solids, at which time the load on the motor decreases. The load on the motor may be monitored by a measurement of the current draw of the motor, or by a torque sensor (not shown) on the motor.

However, in the event that the sensor 420 is detected as being fouled and inoperable 540, the control module 400 adapts the operation of the apparatus 100 to keep it running. With a non-functional sensor condition 540, if the high water sensor is activated 542, this condition may be caused either by an inflow of gray water as described previously, or by an inflow of liquid resulting from a flush of the toilet, wherein some water is filtered through the holes 312 in the intake basket 310. The control module 400 is thus programmed to adapt, and to operate 544 the motor 360 in the macerating mode for the longer time duration.

In the event that a jam of a cutter blade against a solid object in the intake basket occurs, and rotation of the motor 360 is halted, the control module 400 detects this condition and shuts the motor down, while illuminating the jam alarm (red) light 403. Alternatively, circuitry (not shown) may be provided to reverse the direction of rotation of the macerating cutter 330 in order to clear the jam, and to then restore the proper rotation of the cutter 330, and continue the maceration of the solids. In the event that the jam does not clear after a predetermined number of attempts to clear it, the motor 360 may be shut down, and the jam alarm light 403 illuminated.

The Applicants' macerating apparatus may also be provided with improved fittings for connections to an effluent discharge pipe and to a venting pipe. Referring to FIGS. 4, 11A, and 13A, the main cover of the apparatus may be provided with a surface 222 which is formed in the main cover 210 at about a 45 degree angle from vertical and horizontal. A first fitting 250 for conveying discharged effluent from the apparatus 100, and a second fitting 260 for venting vapors and odors from the apparatus 100 are also provided. Fitting 250 is comprised of a flange 252 and a pipe stub 254 extending from the flange 252 (or formed as an arcuate elbow) at a 45 degree angle with the plane of the flange 252. In like manner, fitting 260 is comprised of a flange 262 and a pipe stub 264 extending from the flange 262 at a 45 degree angle with the plane of the flange 262.

Figure 13C:
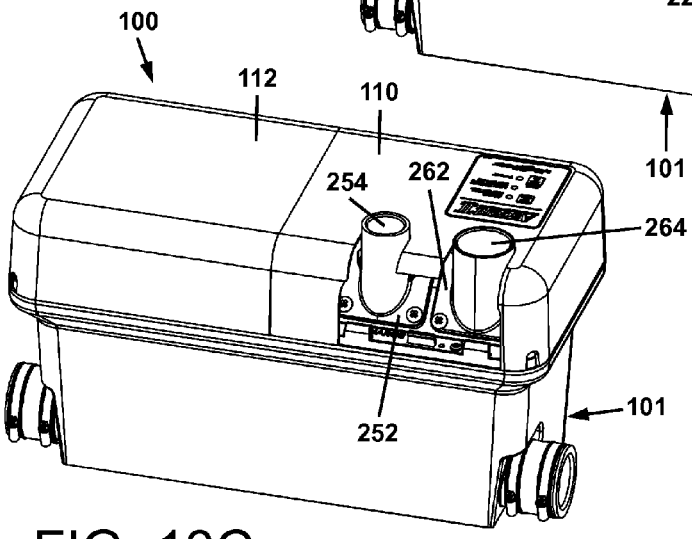
FIG. 13C is a rear perspective view of the macerating apparatus shown with piping connections assembled with the apparatus in a second orientation.

The fitting 250 may be joined to the surface 222 in communication with the effluent outlet port 224, and the fitting 260 may be joined to the surface 222 in communication with the vent port 226 by suitable fasteners (not shown). Referring to FIG. 13B, in a first configuration, the fittings 250 and 260 may be joined to the surface 222 of the cover 210 such that they are directed horizontally, and may be connected to horizontal piping runs (not shown) that may pass through a nearby wall (not shown). Referring to FIG. 13C, in a second configuration, the fittings 250 and 260 may be joined to the surface 222 of the cover 210 such that they are directed vertically (with the decorative/protective cover 110 being notched for clearance), and may be connected to vertical piping runs (not shown) that may pass through a nearby ceiling (not shown). Thus by configuring the outlet fittings 250 and 260 in combination with the main cover 210 in this manner, considerable installation flexibility is provided to suit the user's needs.

Figure 16A:
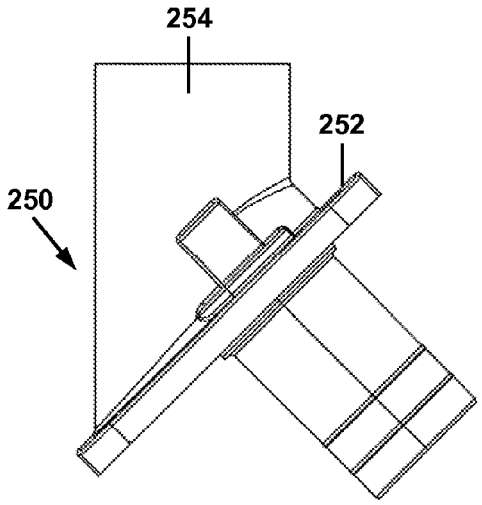
FIG. 16A-16C are illustrations of a liquid outlet fitting for discharging macerated slurry and gray water from the apparatus.
Figure 16B:
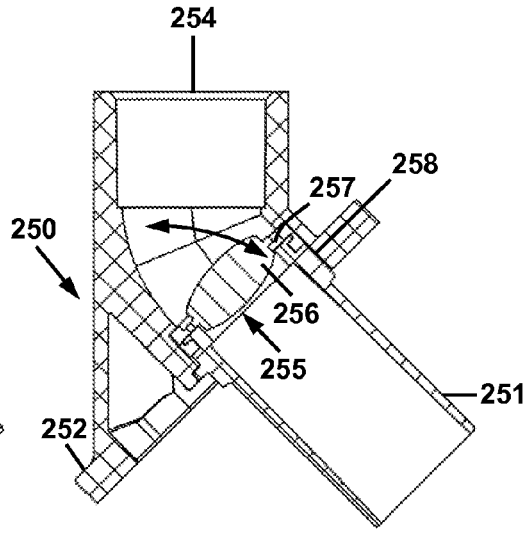
Figure 16C:
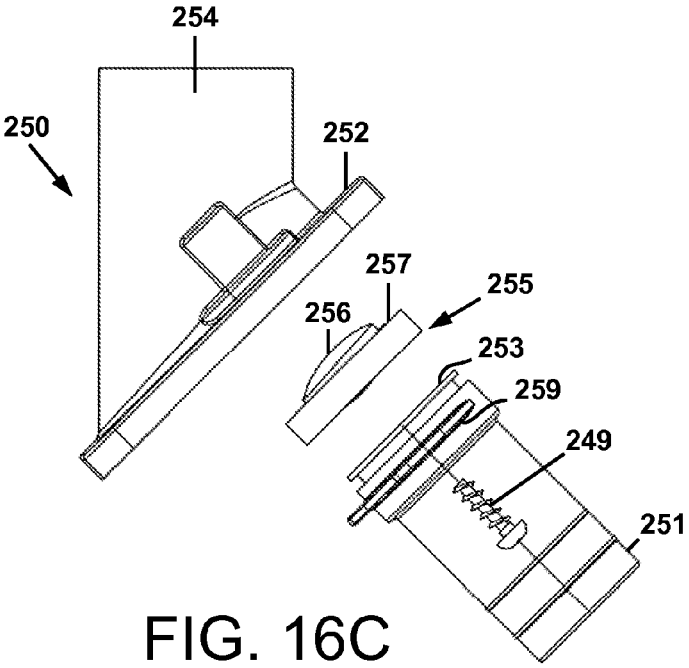

The effluent outlet fitting 250 may be provided with a check valve, so that in the event that the apparatus 100 requires service, the outlet fitting 250 may be removed from the main cover without any backflow and leakage of the contents in the piping connected to the outlet fitting 250. Referring to FIGS. 16A-16C, the check valve 255 may be disposed in the upper end of a pipe stub 251. The check valve 255 may be comprised of a flapper 256 integrally formed with a sealing lip 257, which in turn fits over the end 253 of the pipe stub 251. The flapper 256 pivots to permit outward flow through the fitting 250, but seats on the sealing lip 257 to prevent back flow through the pipe stub 251 and onward into the tank 101 of the apparatus 100, or, undesirably, elsewhere if the outlet fitting 250 is removed from the apparatus 100. The check valve 255 and upper end 253 of the pipe stub 251 may be disposed in a recess 258 in the flange 252. The pipe stub 251 may also be provided with a flange 259 for joining to the fitting flange 252 with suitable fasteners 249. The pipe stub 251 is connected to the outlet 384 of the pump volute 380 by a length of conduit (not shown. The conduit is preferable flexible conduit so as to facilitate removal of the macerating unit 300 as described previously. In an alternative configuration, the effluent outlet port 224 may be provided with a check valve 255 in a similar manner, although this is less desirable because it does not prevent backflow and leakage of the contents in the piping connected to the outlet fitting 250 when the outlet fitting 250 is disconnected from the main cover 210.

It is, therefore, apparent that there has been provided, in accordance with the present invention, a macerating apparatus and method for macerating solid objects in a liquid stream. The macerating apparatus and method are useful for macerating the effluent stream of a toilet. Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims.

We claim:

1. An apparatus for macerating solids contained in liquid effluent discharged from a toilet, the apparatus comprising:

a) an intake basket comprising a side wall;

b) an inlet tube in fluid communication with the side wall of the intake basket and configured to pass into the basket a volume of the liquid effluent and solids received from the toilet;

c) a macerating cutter operatively connected to a motor; and d) a sensor capable of detecting liquid effluent discharged from the toilet and in communication with the motor, wherein when the effluent is discharged from the toilet toward the macerating cutter, the sensor is provided in a location so as to detects the discharge in sufficient advance of solids in the effluent contacting the macerating cutter, to communicate a signal indicative of the discharge to the motor, and to causes the motor to accelerate the macerating cutter to an operating speed sufficient to prevent solids from stopping the macerating cutter, before solids in the effluent contact the macerating cutter.

2. The apparatus of claim 1, wherein the sensor is disposed in the inlet tube of an intake basket containing the macerating cutter.

3. The apparatus of claim 2, wherein the sensor detects effluent flowing in the inlet tube.

4. The apparatus of claim 1, wherein the sensor detects flushing of the toilet.

5. The apparatus of claim 1, wherein the macerating cutter is a rotary macerating cutter comprising a cutting blade defining a plane of rotation, the side wall of the intake basket is a cylindrical side wall partially surrounding the cutter, and the inlet tube is comprised of a cylindrical portion transitioning into an asymmetric biased opening portion intersecting the cylindrical side wall of the intake basket and comprising an outward bulge formed in a lateral lower inward region of the inlet tube and in the plane of rotation of the cutting blade.

6. The apparatus of claim 5, wherein when the cutting blade is rotating, the clearance between a tip of the cutting blade and the asymmetric biased opening portion of the inlet tube is greater than the clearance between the tip of the cutting blade and the cylindrical side wall of the intake basket.

7. The apparatus of claim 1, wherein the intake basket is comprised of a first through hole formed in the side wall of the intake basket through which the inlet tube is in fluid communication with the intake basket, and at least a second through hole formed in the side wall of the intake basket at a level above a lowermost portion of the inlet tube.

8. The apparatus of claim 1, wherein the macerating cutter is a rotary macerating cutter comprised of a first cutter blade rotatable so as to define a plane of rotation and canted so as to define a first canted plane that is non-parallel to the plane of rotation, and a second cutter blade canted so as to define a second canted plane that is parallel to the first canted plane.

9. A method of macerating solids contained in liquid effluent discharged from a toilet, the method comprising:

a) sensing the presence of the liquid effluent in an inlet tube in fluid communication with a side wall of an intake basket of a macerating apparatus, the sensing performed at a location so as to detect the presence of liquid effluent in advance of solids in the effluent contacting a macerating cutter disposed in the intake basket and operatively connected to a motor; and b) communicating a signal indicative of the discharge to the motor and causing the motor to accelerate the macerating cutter to an operating speed sufficient to prevent solids from stopping the macerating cutter, before solids in the liquid effluent contact the macerating cutter.

10. The method of claim 9, wherein the detecting the presence of the liquid effluent comprises detecting the flow of the liquid effluent into the inlet tube of the macerating cutter.

11. The method of claim 9, wherein detecting the presence of the liquid effluent comprises detecting the capacitance of the liquid effluent in the inlet tube of the macerating cutter.

12. The method of claim 9, wherein detecting the presence of the liquid effluent comprises detecting the conductivity of the liquid effluent in the inlet tube of the macerating cutter.

13. The method of claim 9, wherein the macerating cutter is a rotary macerating cutter comprising a cutting blade defining a plane of rotation, the side wall of the intake basket is a cylindrical side wall partially surrounding the cutter, and the inlet tube is comprised of a cylindrical portion transitioning into an asymmetric biased opening portion intersecting the cylindrical side wall of the intake basket and comprising an outward bulge formed in a lateral lower inward region of the inlet tube and in the plane of rotation of the cutting blade; and the method further comprises directing part of the effluent stream through the asymmetric biased opening portion of the inlet tube.

14. The method of claim 9, further comprising discharging the macerated liquid through at least one through hole in the side wall of the intake basket at a level above a lowermost portion of the inlet tube.

15. The method of claim 14, wherein the macerating apparatus is further comprised of a tank containing the intake basket and a pump operatively connected to the motor, and the method further comprises receiving the macerated liquid discharged through the at least one through hole, and pumping the macerated liquid out of the tank.

16. An apparatus for macerating solids contained in liquid effluent discharged from a toilet, the apparatus comprising an intake basket comprising a side wall, an inlet tube in fluid communication with the side wall of the intake basket and configured to pass into the basket a volume of the liquid effluent and solids received from the toilet; a macerating cutter operatively connected to a motor; and means for detecting flushing of the toilet before effluent discharged from the toilet as a result of the flushing contacts the macerating cutter; wherein when the effluent is discharged from the toilet toward the macerating cutter, the means for detecting flushing of the toilet is provided in a location so as to detect the discharge in sufficient advance of solids in the effluent contacting the macerating cutter, to communicate a signal indicative of the discharge to the motor, and to cause the motor to accelerate the macerating cutter to an operating speed sufficient to prevent solids from stopping the macerating cutter, before solids in the effluent contact the macerating cutter.

17. A macerating apparatus for a toilet, the apparatus comprising:

a) an intake basket comprising a side wall including a first through hole and at least a second through hole formed therein;

b) an inlet tube in fluid communication with the intake basket through the first through hole and having a lowermost portion located at a level below the second through hole;

c) a macerating cutter disposed in the intake basket and operatively connected to a motor; and d) a sensor disposed in communication with the motor such that when effluent is discharged from the toilet toward the macerating cutter, the sensor detects the discharge and causes the motor to operate the macerating cutter before the effluent contacts the macerating cutter.

18. The apparatus of claim 17, wherein the sensor is provided in a location so as to detect the discharge from the toilet in sufficient advance of solids in the effluent contacting the macerating cutter, to communicate a signal indicative of the discharge to the motor, and to cause the motor to accelerate the macerating cutter to an operating speed sufficient to prevent solids from stopping the macerating cutter, before the effluent contacts the macerating cutter.

19. The apparatus of claim 17, wherein the macerating cutter is a rotary macerating cutter comprising a cutting blade defining a plane of rotation, the side wall of the intake basket is a cylindrical side wall partially surrounding the cutter, and the inlet tube is comprised of a cylindrical portion transitioning into an asymmetric biased opening portion intersecting the cylindrical side wall of the intake basket and comprising an outward bulge formed in a lateral lower inward region of the inlet tube and in the plane of rotation of the cutting blade.

20. The apparatus of claim 17, further comprising a tank containing the intake basket and a pump operatively connected to the motor and configured to receive macerated liquid discharged through the at least second through hole of the side wall of the intake basket.

* * * * *